US006394294B1

(12) United States Patent
Briere

(10) Patent No.: US 6,394,294 B1
(45) Date of Patent: May 28, 2002

(54) CLOSURE HAVING TORQUE-REDUCING FEATURE

(75) Inventor: Marc A. Briere, Newburgh, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/316,610

(22) Filed: May 21, 1999

Related U.S. Application Data

(60) Provisional application No. 60/086,277, filed on May 21, 1998.

(51) Int. Cl.[7] ..... B65D 41/34; B65D 50/00

(52) U.S. Cl. ..... 215/252; 215/258; 215/901

(58) Field of Search ..... 215/252, 253, 215/329, 331, 250, 901, 258

(56) References Cited

U.S. PATENT DOCUMENTS

| | | | | |
|---|---|---|---|---|
| 4,913,300 A | * | 4/1990 | Wiedmer et al. | 215/252 |
| 4,978,017 A | * | 12/1990 | McBride | 215/252 |
| 5,131,550 A | * | 7/1992 | Thompson | 215/252 |
| 5,603,422 A | * | 2/1997 | Herrmann | 215/252 |
| 5,782,369 A | * | 7/1998 | Tansey | 215/252 |
| 5,927,527 A | * | 7/1999 | Montgomery et al. | 215/252 |
| 5,941,403 A | * | 8/1999 | Towns | 215/252 |
| 5,967,351 A | * | 10/1999 | Ekkert | 215/252 |

FOREIGN PATENT DOCUMENTS

| | | | | |
|---|---|---|---|---|
| WO | WO-85/03492 A1 | * | 8/1985 | 215/252 |

* cited by examiner

*Primary Examiner*—Lee Young
*Assistant Examiner*—Niki M. Eloshway
(74) *Attorney, Agent, or Firm*—Charles G. Lamb; John F. Salazar; Middleton Reutlinger

(57) ABSTRACT

A safety closure and a container is comprised of a container having an externally threaded neck portion and a first locking bead spaced downwardly from the threaded neck portion and a closure having a cap portion and a tamper indicating band portion. The cap portion is provided with a top wall and a side wall which extends downwardly from an outer periphery of the top wall and terminates in a lower end. The side wall is provided with an internal thread which is engageable with the externally threaded neck portion of the closure. The tamper indicating band portion is attached to the lower end of the cap portion with a plurality of frangible bridge segments. The tamper indicating band portion is also provided with an inwardly projecting second bead which is engageable with the first beads whereby the engagement of the bead prevents removal of the tamper indicating band portion upon removal of the cap portion. At least one ramp is integrally formed with the second bead and projects downwardly therefrom. Engagement of the beads prevents removal of the tamper indicating band portion upon removal of the cap portion.

3 Claims, 6 Drawing Sheets

CLOSURE HAVING TORQUE-REDUCING FEATURE

CROSS-REFERENCE TO RELATED APPLICATION

This is a continuation of the Provisional Application Serial No. 60/086,277 filed May 21, 1998.

BACKGROUND OF THE INVENTION

The present invention relates to safety closures for use on containers. More particularly, the present invention relates to a safety closure for use on a container, wherein the safety closure is provided with means to assist in affixing the safety closure to the container.

In recent years there have been many proposed arrangements for closures attaching to containers to prevent the tampering of the contents of the container or in the alternative to provide a consumer with an indication as to whether or not the container has been tampered with. There have been proposed a number of different tampering indicating means provided on closures whereby upon the initial opening of the closure, a portion of the closure is left on the neck of the container.

SUMMARY OF THE INVENTION

It is an object of the present invention to provide a tamper indicating device for a closure.

It is another object of the present invention to provide a tamper indicating device of a closure wherein a portion of the closure is left on the neck of a container upon the initial removal of the closure.

It is a further object of the present invention to provide an inexpensive closure with a tamper indicating device unitary therewith.

More particularly, the present invention provides a safety closure and a container having torque reducing capabilities wherein the container is provided with an externally threaded neck portion and a first locking bead spaced downwardly from the threaded neck portion. The closure comprises a cap portion and a tamper indicating band portion. The cap portion is provided with a top wall and a side wall which extends downwardly from an outer periphery of the top wall and terminates in a lower end. The side wall has an internal thread engageable with the externally threaded neck portion. The tamper indicating band portion is attached to the lower end with a plurality of frangible bridge segments. Moreover, the tamper indicating band portion has an inwardly projecting second bead engageable with the first bead whereby the engagement of the beads prevents removal of the tamper indicating band portion upon removing the cap portion. The torque reduction is accomplished via an integrally molded ramp located on the tamper indicating band and projecting downwardly from the second bead. During assembly of the cap to the container said ramp acts to "tire" the second bead over the first locking bead of the container.

BRIEF DESCRIPTION OF THE DRAWINGS

A better understanding of the present invention will be had with reference to the following description in conjunction with the accompanying drawings in which like reference numerals refer to like parts, and wherein.

DETAILED DESCRIPTION OF THE PREFERRED EMBODIMENT

Figure 1:
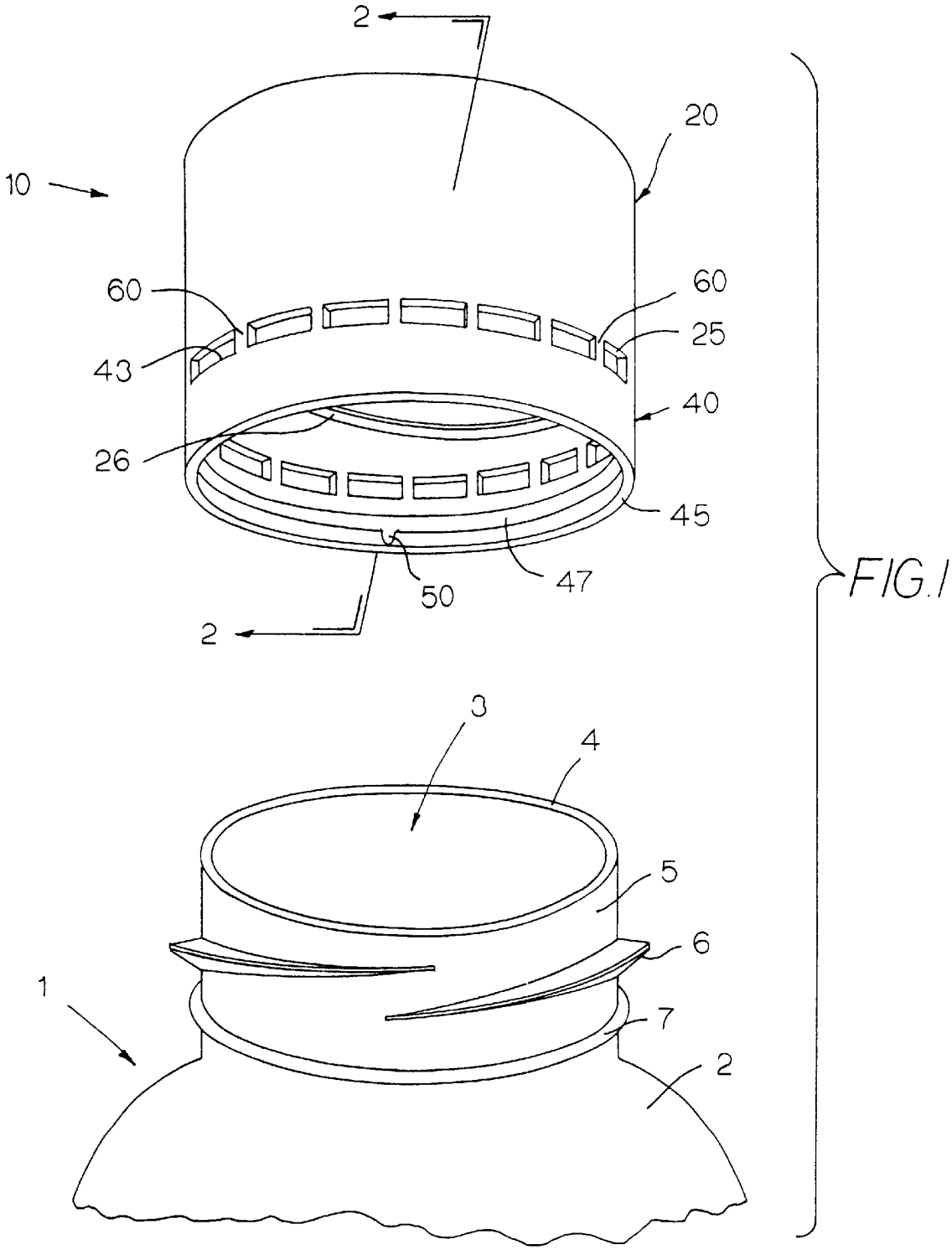
FIG. 1 is a perspective view of a safety closure according to a preferred embodiment of the present invention, shown in spaced relation to a neck portion of a container.
Figure 2:
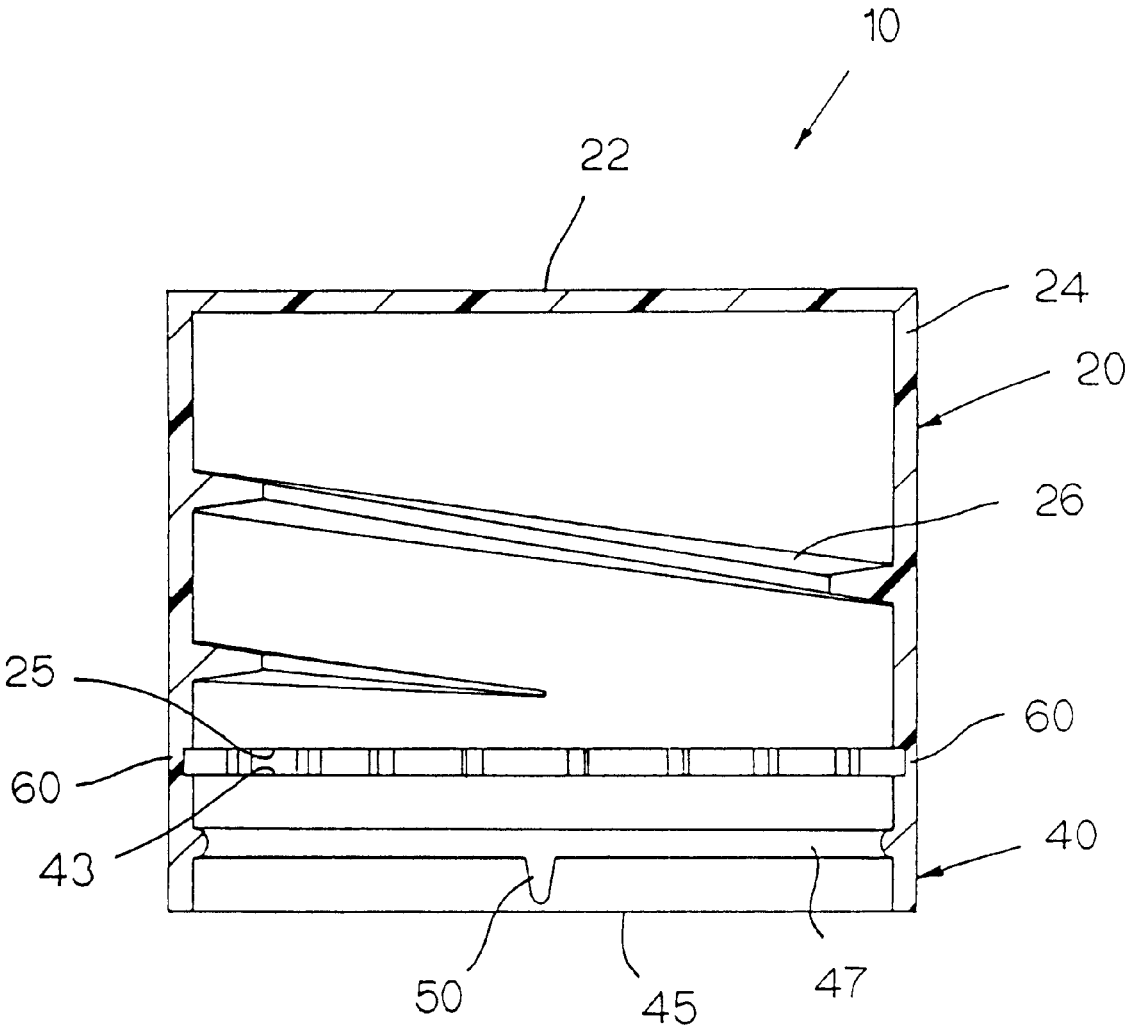
FIG. 2 is a section view of the safety closure of FIG. 1, shown along section line 2—2 of FIG. 1.
Figure 3:
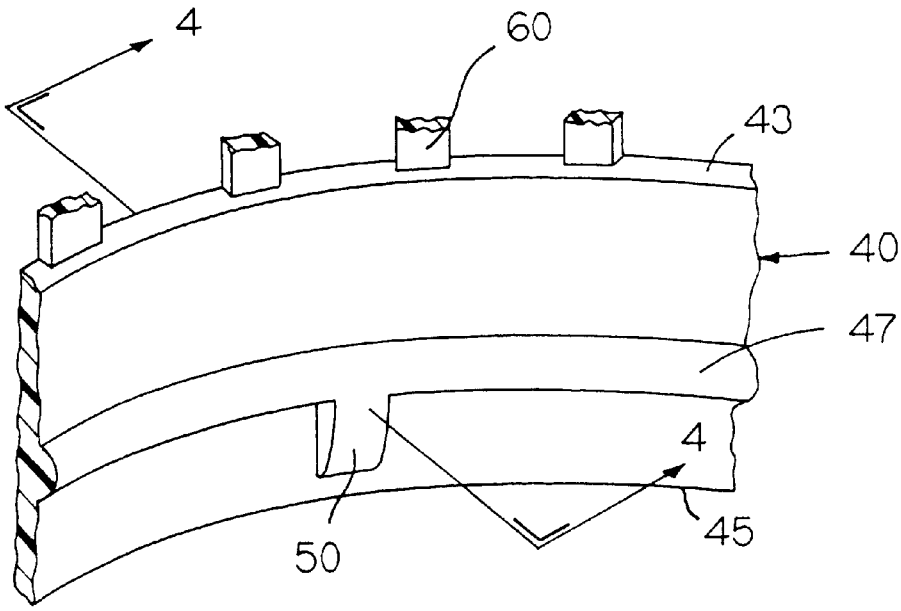
FIG. 3 is a detail perspective view of a tamper-indicating band portion of the safety closure of FIG. 1.
Figure 4:
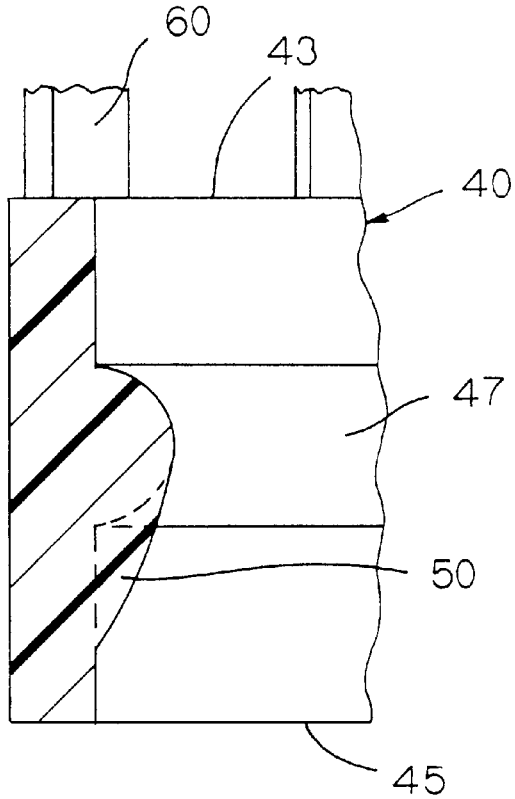
FIG. 4 is a section view of the tamper-indicating band portion of FIG. 3, shown along section line 4—4 of FIG. 3.
Figure 5:
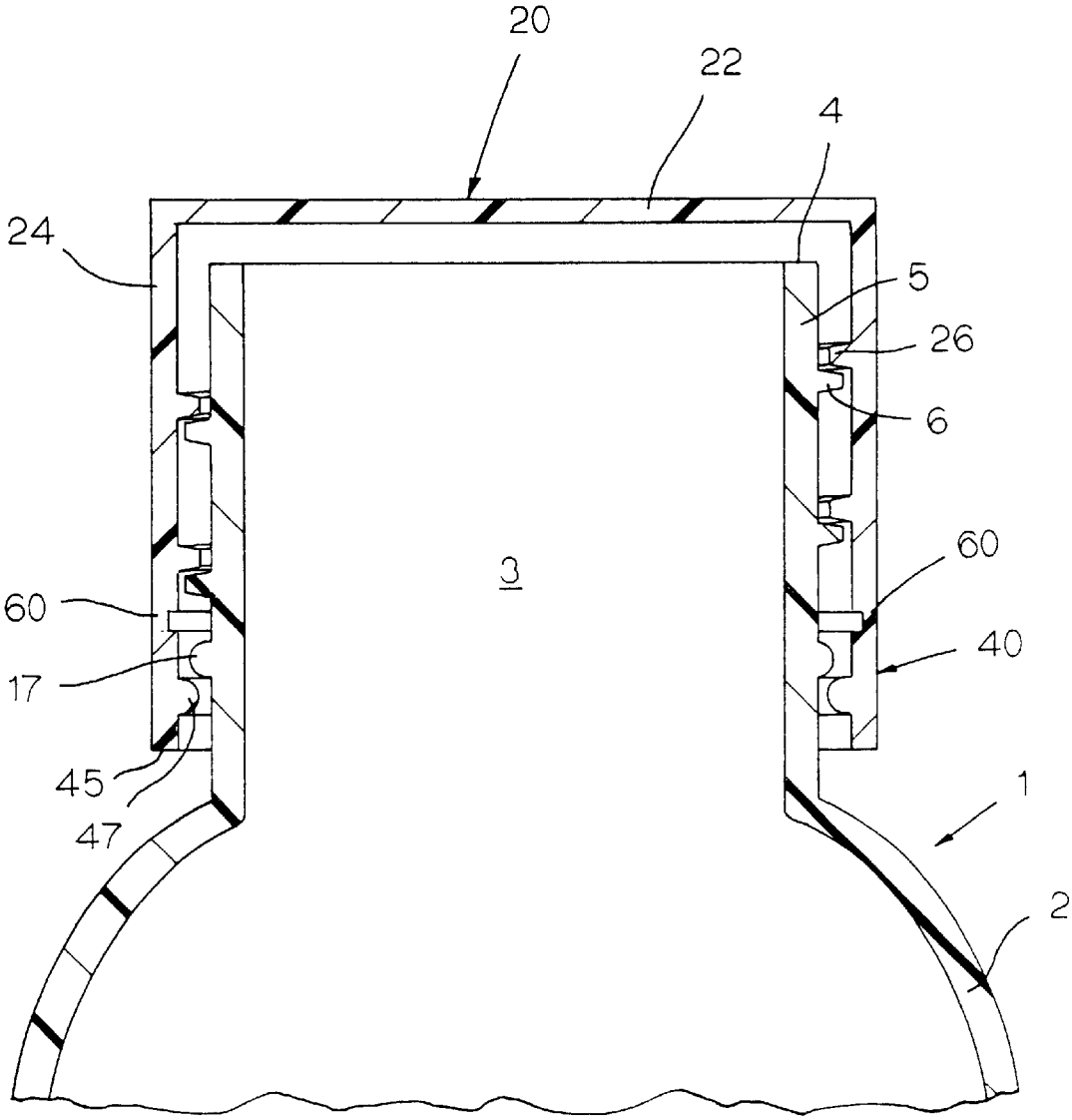
FIG. 5 is a section view of the safety closure of FIG. 1, shown affixed to the container neck portion of FIG. 1, and shown along section line 2—2 of FIG. 1.

With combined reference to FIGS. 1—5, a safety closure 10 according to a preferred embodiment of the present invention is sized to be threadingly affixed to a container 1 having a body portion 2 defining a cavity 3 therein and a neck portion 5 having an open upper end 4 which communicates with the cavity 3 to permit filling and dispensing of the cavity 3 therethrough. The container neck portion 5 includes an external thread 6 and a continuous first locking bead 7, both of which project radially outwardly from an outer surface thereof. The closure 10 and the container 1 are preferably constructed from an injection-molded polymer, such as, polyethylene, polypropylene or the like, which provides sufficient rigidity to store the container contents in an upright orientation.

The closure 10 includes a cap portion 20 and a tamper-indicating band portion 40 connected to the cap portion 20 by a plurality of frangible bridge segments 60. The cap portion 20 includes a top wall 22 and a side wall 24 depending downwardly from an outer periphery of the top wall 22 and terminating in a lower end 25 thereof which is connected to an upper end 43 of the band portion 40 by the plurality of bridge segments 60. An internal thread 26 projects inwardly from an inner surface of the side wall 24 and is sized to engage the external thread 6 of the container neck portion 5. An underside surface 23 of the top wall 22 may include a removable liner (not shown), an integral linerless plug (not shown), or the like, to sealingly engage the upper end of the container neck portion 4 and to prevent unwanted spillage of liquid contents from the container 1.

The band portion 40 includes a continuous circumferential second locking band bead 47 projecting outwardly from an inner surface thereof. The second band bead 47 is sized to engage the container neck portion first locking bead 7 to inhibit removal of the band portion 40 from the container neck portion 5 when the closure cap portion 20 is removed a first time therefrom. At least one ramp 50 is integrally-formed with both the band portion 40 and the band bead 47 and projects downwardly from the band bead 47 towards a lowermost edge 45 of the band portion 40, ramp 50 tapering inwardly of the band portion 40 in a downward direction, such that the ramp 50 is integral with the inner surface of the band portion 40 at the lowermost edge 45 thereof.

Figure 7:
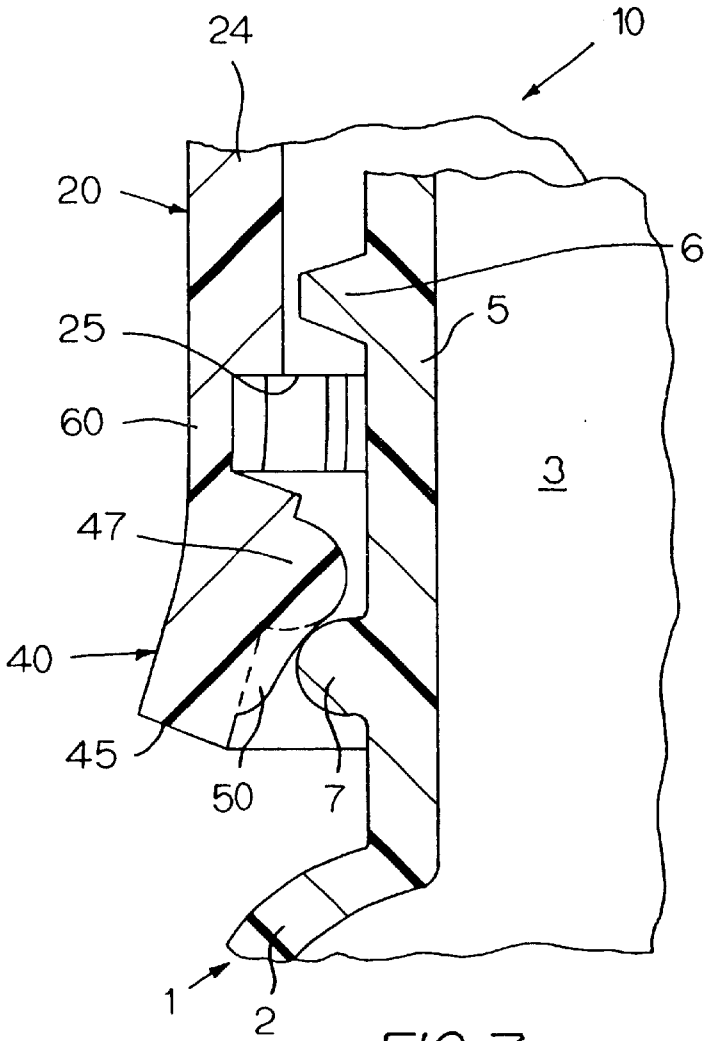
FIG. 7 is a detail perspective view of the tamper-indicating band portion of the safety closure of FIG. 1, shown in spaced relation to the container neck portion of FIG. 1, and shown as the tamper-indicating band portion engages the container neck portion.
Figure 6:
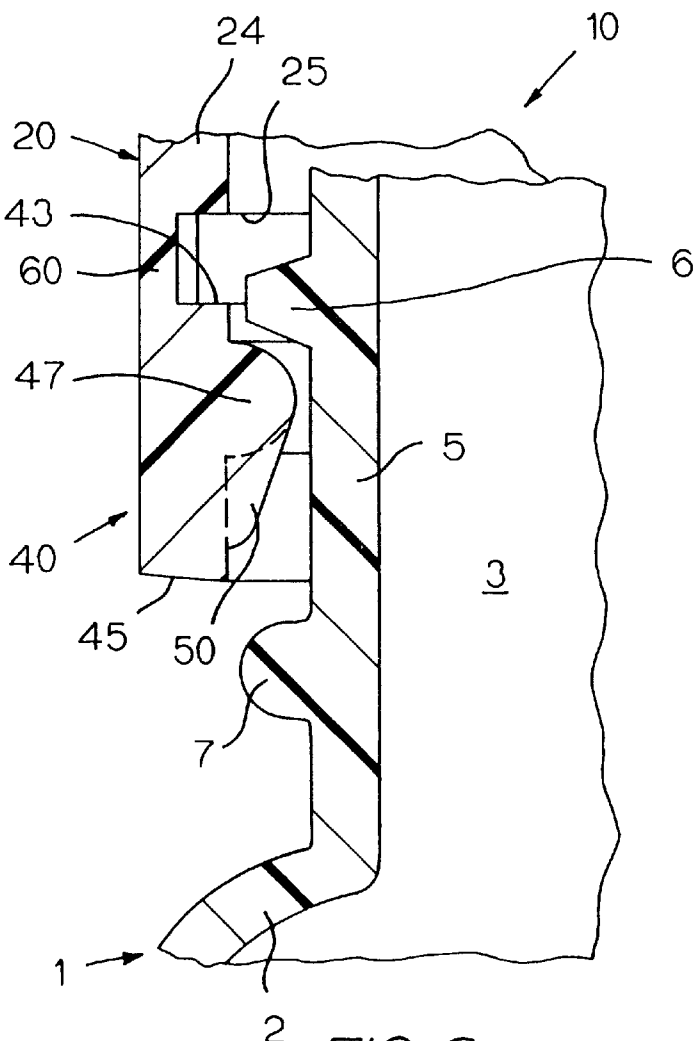
FIG. 6 is a detail perspective view of the tamper-indicating band portion of the safety closure of FIG. 1, shown in spaced relation to the container neck portion of FIG. 1, and shown prior to the tamper-indicating band portion engages a continuous locking bead provided on the container neck portion.
Figure 8:
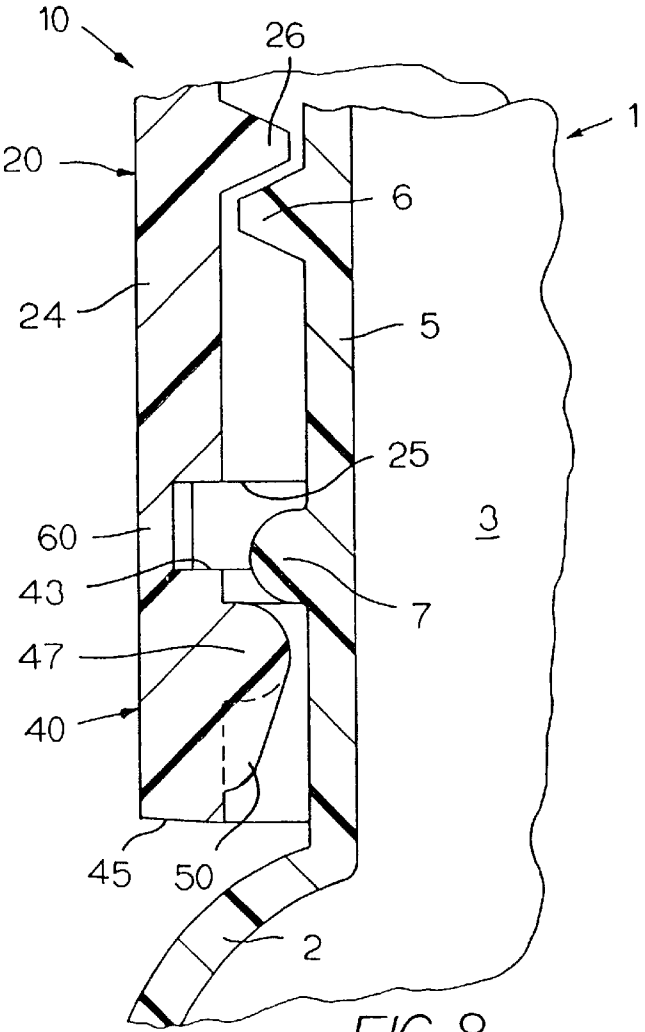
FIG. 8 is a detail perspective view of the tamper-indicating band portion of the safety closure of FIG. 1, shown in spaced relation to the container neck portion of FIG. 1, and shown with the safety closure being fully-affixed to the container neck portion.

With additional reference to FIGS. 6—8, the ramp 50 aids in affixing the closure 10 to the container neck portion 5, and more particularly, reduces the torque necessary to lift the band portion bead 47 over and below the container neck portion first locking bead 7 while affixing the closure 10 to the container neck portion 5. As the closure 20 is threadingly affixed to the container neck portion 5, the band portion bead 47 travels axially downwardly towards the container body portion 2, as shown generally in FIG. 6. Further threading causes the container bead 7 to abut the ramp 50, thereby deflecting the band portion 40 radially outwardly in a region surrounding the ramp 50, as shown generally in FIG. 7, and guiding the band portion bead 47 over the container bead 7. Even further threading causes the band portion bead 47 to pass axially below the container bead 7, at which point the band portion bead 47 snaps radially inwardly below the container bead 7, as shown generally in FIG. 8.

Figure 9:
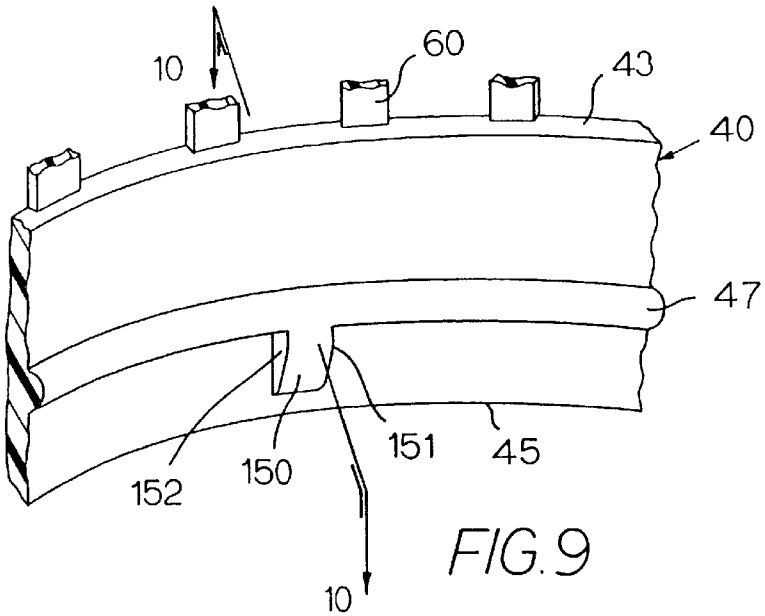
FIG. 9 is a detail perspective view of a tamper-indicating band portion of a safety closure shown according to another embodiment of the present invention; and, FIG. 10 is a section view of the tamper-indicating band portion of FIG. 9, shown along section line 10—10 of FIG. 9.
Figure 10:
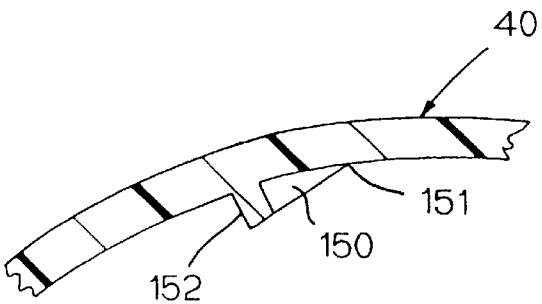

With reference to FIGS. 9 and 10, a ramp 150 according to another embodiment of the present invention is tapered outwardly away from the inner surface of the band portion and includes a leading edge 151 integral with the inner surface of the band and an opposed abutment 152. The ramp 150 according to the present embodiment operates in the same manner as the ramp 50 according to the preferred embodiment hereof; however, the tapered ramp 150 according to the present embodiment better guides the band portion bead 47 over the container bead 7. In either embodiment, the ramp 50, 150 guides the band portion bead 47 over the container bead 7 in a manner similar to the manner in which a conventional bicycle tire is mounted to a conventional tire frame; that is, a limited arcuate region of the band portion bead 47 is guided over the container bead 7 corresponding to the arcuate position of the ramp 50, 150 with respect to the container bead 7. As the ramp 50, 150 is rotated around the container neck portion 5, only a small arcuate portion of the band portion bead 47 is guided over the container bead 7 at any one time, thereby reducing the amount of torque necessary to affix the closure 10 to the container neck portion 5.

Alternatively, a ramp being similar in construction to the ramp 50, 150 according to either embodiment hereof, may be formed with any retaining bead of the type described hereinabove, and the present invention is not limited only to the embodiments described herein. For example, a closure not having a tamper-indicating band, but having a retaining bead thereon may be provided with a ramp as described hereinabove to aid in affixing the closure to a container neck portion.

Although the present invention has been described in terms of specific embodiments set forth in detail, it should be understood that this is by illustration only and that the present invention is not limited thereto, since alternative embodiments not described herein will become apparent to those skilled in the art in view of the disclosure. Accordingly, modifications are contemplated which can be made without departing from either the spirit or the scope of the present invention as described.

What is claimed is:

1. A safety closure and container comprising:

a container having an externally threaded neck portion and first locking bead spaced downwardly from said threaded neck portion; and, a closure comprising a cap portion and a tamper indicating band portion, said cap portion having a top wall and side wall extending downwardly from an outer periphery of the top wall and terminating in a lower end, said side wall having an internal thread engageable with said externally threaded neck portion, said tamper indicating band portion being attached to said lower end with a plurality of frangible bridge segments, said tamper indication band portion having an inner surface with an outwardly projecting continuous circumferential second bead engageable with said first bead and a single ramp integrally formed with a selected circumferential portion of said second bead and projecting downwardly and inwardly therefrom whereby said engagement of said beads prevents removal said tamper indicating band portion upon removal of said cap portion.

2. The safety closure and container of claim 1 wherein said one ramp is integral with a lowermost edge of said band portion.

3. The safety closure and container of claim 1 wherein said one ramp tapers outwardly away from said band portion and includes a leading edge integral with the inner surface of the band and an opposed abutment.

* * * * *